United States Patent [19]

Long, Jr.

[11] Patent Number: 4,839,962

[45] Date of Patent: Jun. 20, 1989

[54] HARNESS-MAKING MACHINE HAVING IMPROVED CABLE GUIDE

[75] Inventor: Alden O. Long, Jr., Carlisle, Pa.

[73] Assignee: AMP Incorporated, Harrisburg, Pa.

[21] Appl. No.: 268,113

[22] Filed: Nov. 7, 1988

[51] Int. Cl.[4] ..... H01R 43/00

[52] U.S. Cl. ..... 29/749; 29/753; 29/759

[58] Field of Search ..... 29/749, 753, 759, 564.1, 29/564.6, 33 M

[56] References Cited

U.S. PATENT DOCUMENTS

| | | |
|---|---|---|
| 4,110,880 | 9/1978 | Peppler et al. . |
| 4,359,257 | 11/1982 | Lopinski et al. . |
| 4,410,229 | 10/1983 | Stephenson . |
| 4,570,326 | 2/1986 | Meyer et al. . |
| 4,647,323 | 3/1987 | Darstein et al. . |
| 4,682,391 | 7/1987 | Hall, Jr. et al. . |

*Primary Examiner*—Carl E. Hall

*Attorney, Agent, or Firm*—Frederick W. Raring; James M. Trygg

[57] ABSTRACT

Harness-making machine has a connector installing station, a staging zone adjacent to the installing station for holding a stack of connectors, and a cable dispensing or feeding unit adjacent to the staging zone. Cable is fed from the feeding unit through the staging zone to the installing station at which the leading connector on the stack is installed on the cable. The dispensing unit has a cable guide which extends through the staging zone to the installing station thereby to protect the cable from the terminals which extend from the connectors contained in the staging zone. This guide thereby prevents jamming of the machine which can occur if cable movement through the staging zone is impeded by the terminals.

13 Claims, 7 Drawing Sheets

HARNESS-MAKING MACHINE HAVING IMPROVED CABLE GUIDE

FIELD OF THE INVENTION

This invention relates to harness-making machines of the type in which a plurality of connectors are stacked in a connector staging zone and cable is fed from an endless source past the stack to the leading connector thereof. The leading connector is installed on the cable and the connector is thereafter moved along a predetermined feed path. The cable is pulled from the source as a result of the movement of the leading connector. The second connector in the stack is then installed on the cable and the operations are repeated until all of the connectors in the staging zone have been installed on the cable. The cable is then cut. The invention is particularly directed to the achievement of an improved cable guide for facilitating movement of the cable through the stack of connectors.

BACKGROUND OF THE INVENTION

U.S. Pat. No. 4,682,391 (which is hereby incorporated by reference) describes in detail a harness-making machine having a connector installing station or zone for installing a connector on a cable, a staging area which holds a stack of connectors, and a cable feeding or dispensing unit adjacent to the staging zone. The harness is produced by advancing cable from an endless source, such as a reel, through the dispensing unit, past the stack of connectors, and to the leading connector of the stack. The leading connector is installed on the cable and the leading connector is then moved along a rectilinear path away from the installing station drawing with it a portion of the cable. The second connector of the stack is then moved to the installing station and installed on the cable. These operations are repeated until all of the connectors have been installed on the cable. The cable is cut by a severing device in the dispensing unit and the harness is removed from the machine.

The connectors are of the type having a cable receiving surface or face and having terminals extending normally from the cable receiving face. The terminals have wire receiving slots so that the installation process merely requires that the cable be pressed down towards and against the cable receiving face. The conductors in the cable will enter the slots of the terminals and thereby be electrically connected to the terminals.

Harness-making machines of the type described above are being widely used and, while recent machines have been substantially improved by the addition of controls for producing the harnesses without human intervention and improved means for feeding the cable and controlling the movement of the connectors away from the installing station, the latest machines incorporate the essential features of the machine described in U.S. Pat. No. 4,682,391.

Under some circumstances, problems have been encountered with cable-making machines of the type described above in that difficulty is experienced when the cable is advanced through the dispensing unit past the connectors in the stack. The cable must move past the ends of the individual terminals of the connectors and it has been observed that under some circumstances, the ends of these terminals engage the cable while it is being fed and impede its movement through the stack of connectors. In other words, under some circumstances, the machine becomes jammed and the intervention of a human operator is required to correct the problems encountered. The present invention is directed to the achievement of a cable guide for guiding the cable from the cable dispensing unit to the leading connector of the stack of connectors in the staging zone and preventing any interference with the movement of the cable by the terminals in the connectors which are in the staging zone.

THE INVENTION

A harness-making machine in accordance with the invention comprises a connector installing station having installing means therein for installing the connector on the ribbon cable, a connector positioning means at the installing station for locating the connector relative to the installing means, and a cable dispensing unit proximate to the installing station for dispensing cable from a cable source. The machine is characterized in that a cable guide is provided on the dispensing unit, the cable guide extending, cantilever fashion, from the dispensing unit towards the installing station. The guide has a free end which is spaced from the dispensing unit and adjacent to the installing station. The cable guide is movable between a retracted position and a forward position, the free end of the cable guide being adjacent to the installing station when the guide is in its forward position and is retracted from the installing station when the cable guide is in its retracted position. A connector can thus be placed in the positioning means when the dispensing unit is in its retracted position and upon movement of the cable guide to its forward position, cable dispensed from the dispensing unit and through the cable guide will have an emergent portion thereof in the installing station and the connector can be installed on the cable.

In the preferred embodiment, the cable guide is fixed to the dispensing unit and the dispensing unit is movable between retracted and forward positions whereby the guide is also moved between its retracted and forward positions. The cable guide comprises a funnel-like member having opposed flat surfaces and side flanges which confine the cable and which support it as it moves from the dispensing unit towards the installing station.

Advantageously, a connector holding zone or staging zone is provided between the installing station and the dispensing unit, the holding zone being capable of holding a plurality of connectors therein whereby an individual connector can be moved from the holding zone to the installing station during each operating cycle of the machine. The cable guide extends from the dispensing unit through the holding zone to the installing station. When the cable guide is in its retracted position, it does not extend into the holding zone thereby to permit the loading of a plurality of connectors in the holding zone at the beginning of a cable manufacturing operation.

THE DRAWING FIGURES

THE DISCLOSED EMBODIMENT

Figure 1:
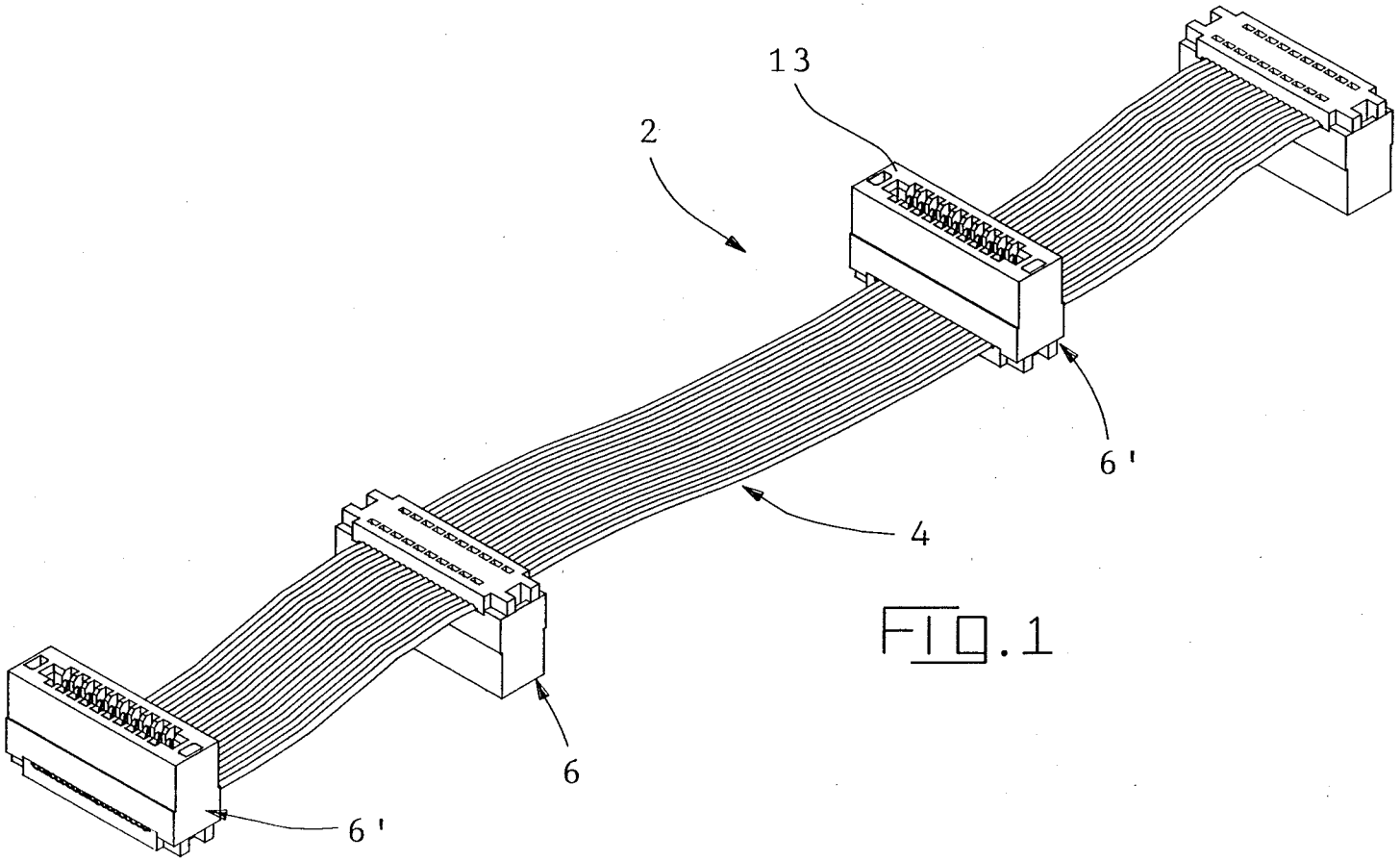
FIG. 1 is a perspective view of a harness of the type produced by a machine in accordance with the invention.

A harness 2 of the type produced by a machine in accordance with the invention comprises (FIG. 1) a multi-conductor ribbon cable 4 having connectors 6, 6', installed thereon at predetermined locations. The connectors are identical to each other, however, the connectors 6', are oriented oppositely from the connectors 6. The connectors are of the general type described in U.S. Pat. No. 4,410,229 (which is hereby incorporated by reference) and will be described only briefly and to the extent necessary for an understanding of the present invention.

Figure 2:
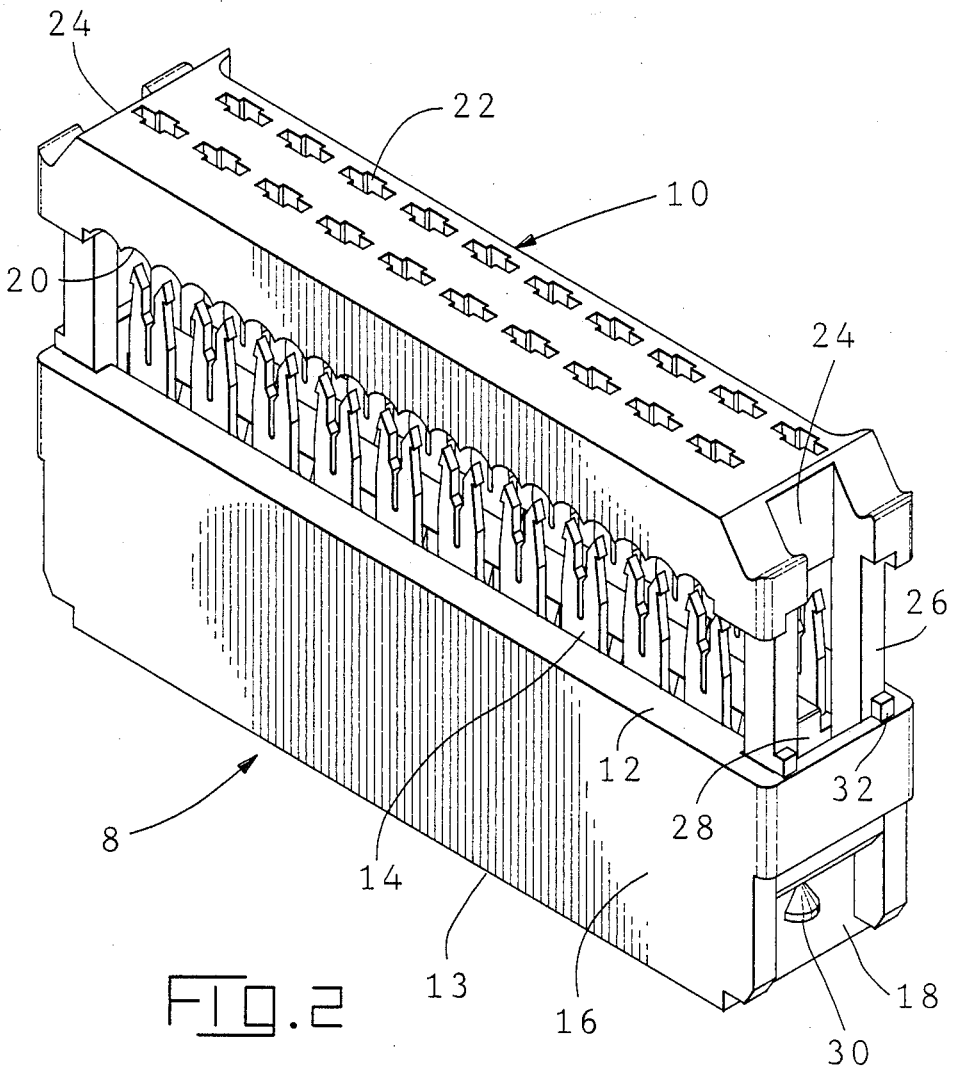
FIG. 2 is a perspective view showing an electrical connector.

Each connector comprises a body portion 8 and a cover 10. The body has a cable-receiving face 12 and a mating face 13 which faces oppositely with respect to the cable-receiving face. Body portion 10 contains a plurality of terminals 14 which have end portions that extend upwardly, as viewed in FIG. 2, from the cable-receiving face 12. The projecting portions of the terminals 14 have wire-receiving slots and the cable 4 can be connected to the terminals by merely moving the cable downwardly so that the terminals penetrate the cable and the conducting wires in the cable are received in the slots. The body portion 8 of the connector has oppositely facing side surfaces 16 and oppositely facing end surfaces 18. The cover member 10 is generally rectangular and conforms to the outline of the cable-receiving face 12. The cover has a major surface 20 which is opposed to the cable-receiving face 12 and has openings 22 extending therethrough which receive the projecting portions of the terminals. The cover has ends 24 and has latch arms in the forms of hasps 26 depending from these ends. The latch arms are dimensioned to be received in rectangular openings 28 on the ends of the body of the connector. Stops 32 are provided on the latch arms so that the cover member can be partially assembled to the body member; that is, the latch arms can be inserted through the openings 28 until the stops 32 are against the body member. When the connector is in this partially assembled condition, there will be clearance between the upper ends of the terminals 14 and the major surface 20 of the cover so that the cable can be threaded through this clearance. Thereafter, the cover member is moved downwardly and against the cable-receiving face 12 until ears 30 on the ends of the body engage the latch arms. The downward movement of the cover member pushes the conductors in the cable 4 into the wire-receiving slots of the terminals 14.

It will be apparent that in order to install a connector on the cable, it is necessary then to thread the cable into the space which is between the ends of the terminals and the major surface 20 of the cover member. If the operation is being carried out manually, it is easily performed. However, if the operation is being carried out with a machine disclosed in U.S. Pat. No. 4,682,391, the upper ends of the terminals may impede movement of the cable through the connector and when the upper ends of the terminals are pointed as shown, the pointed ends may penetrate the cable and cause the machine to jam. As will be explained before, machines of the type disclosed in the above-identified U.S. Pat. No. 4,682,391 have a staging zone or holding zone in which a plurality of connectors are stacked. This holding zone is adjacent to the installing station and the cable must therefore be moved or threaded through all of the connectors in the stack as well as into the leading connector thereof which is, in a particular operating cycle, to be installed on the cable. The difficulties discussed above with regard to jamming of the cable are therefore multiplied when a cable-making machine is being used to manufacture the harness. A cable guide in accordance with the invention avoids these problems of machine jamming during a cable manufacturing process.

Figure 3:
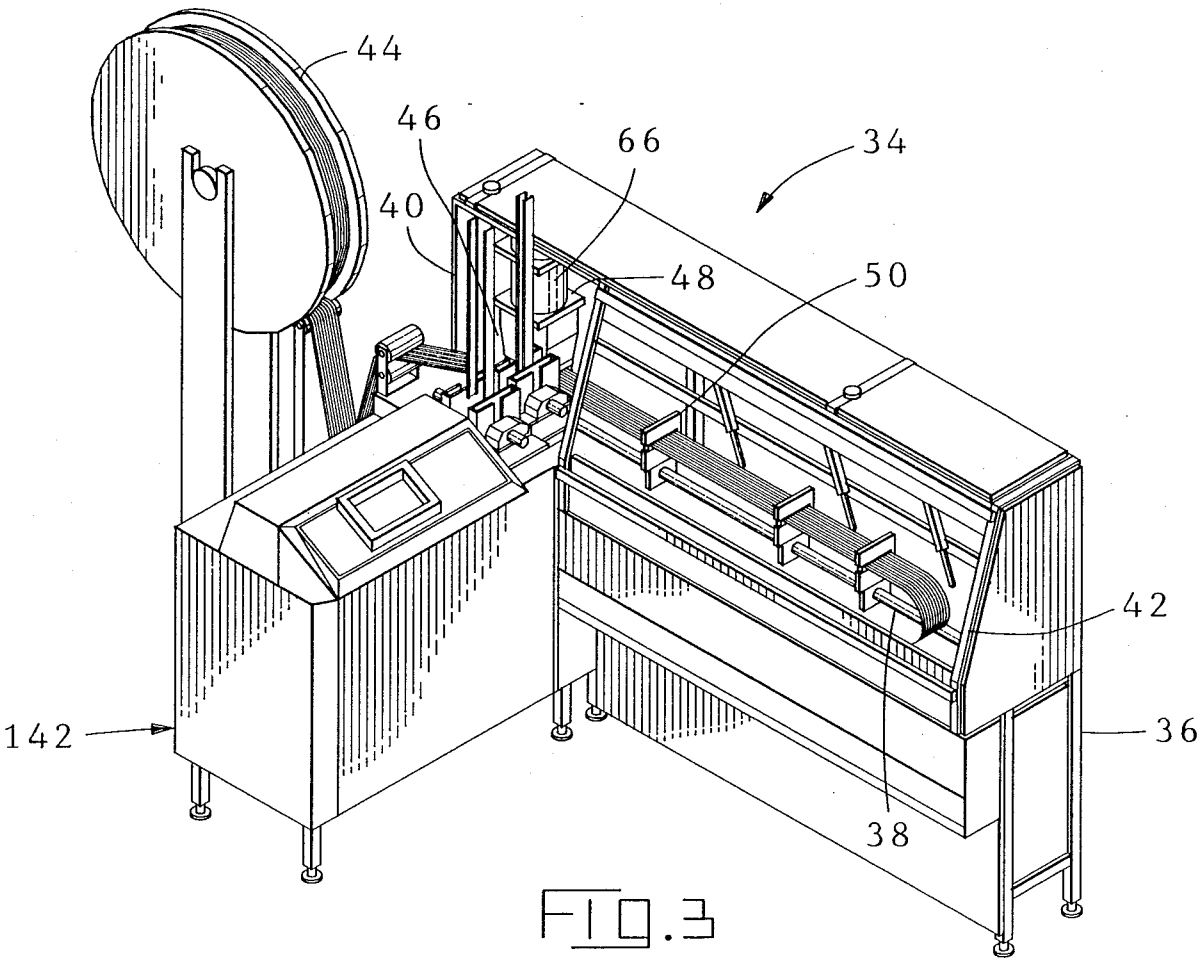
FIG. 3 is a view showing the machine.

The cable-making machine (FIGS. 3–5) 34 will be described only to the extent necessary for an understanding of the present invention and reference is made to the above-identified U.S. Pat. No. 4,682,391 for features not specifically described below. As mentioned previously, the machine shown in FIG. 3 incorporates several improvements which are not described in the above-identified U.S. Patent, however, the principles of operation and the essential structural features are substantially similar to those corresponding features and principles shown in the patent.

The machine has a table-like support 36 having spaced-apart parallel guide rails 38 therein which extend from a first end 40 of the support to a second end 42 thereof. The cable 4 is supplied from a reel 44 and is unreeled through a suitable dereeling mechanism and fed to a feeding unit 46 described in detail below. The cable extends through the feeding unit, through a staging zone 49 (FIG. 7) and to an applicator or press assembly 48 at which the individual connectors are installed on the cable. Each connector which is to be installed on the cable is carried by a connector positioning means or fixture 50 (FIG. 5) which is of the general type disclosed in U.S. Pat. No. 4,682,391. The fixture has lower and upper body portions 52, 54. The lower and upper body portions of each fixture are maintained normally in spaced-apart relationship by means of interfitting guides 56 and are movable relatively towards each other but are maintained in their spaced relationship by spring means 58. Lower and upper inserts 60, 62 are removably contained in the lower and upper bodies and the inserts in turn receive the individual parts of an individual connector 6. The inserts required for a particular connector will of course conform to the dimensions and the configuration of the body of the connector. The upper body 54 has an upper surface 64 against which a ram, described below, moves when the upper body portion is moved towards the lower body portion. The upper or cover portion 10 of the connector will thereby be moved towards the main body portion 8 of the connector and the connector will be installed on a portion of the cable extending between the cover and the main connector body. The fixtures are not directly mounted on the guide rails 38 but are rather supported on carriers 72 which are in turn slidably mounted on the guide rails 38.

Figure 7:
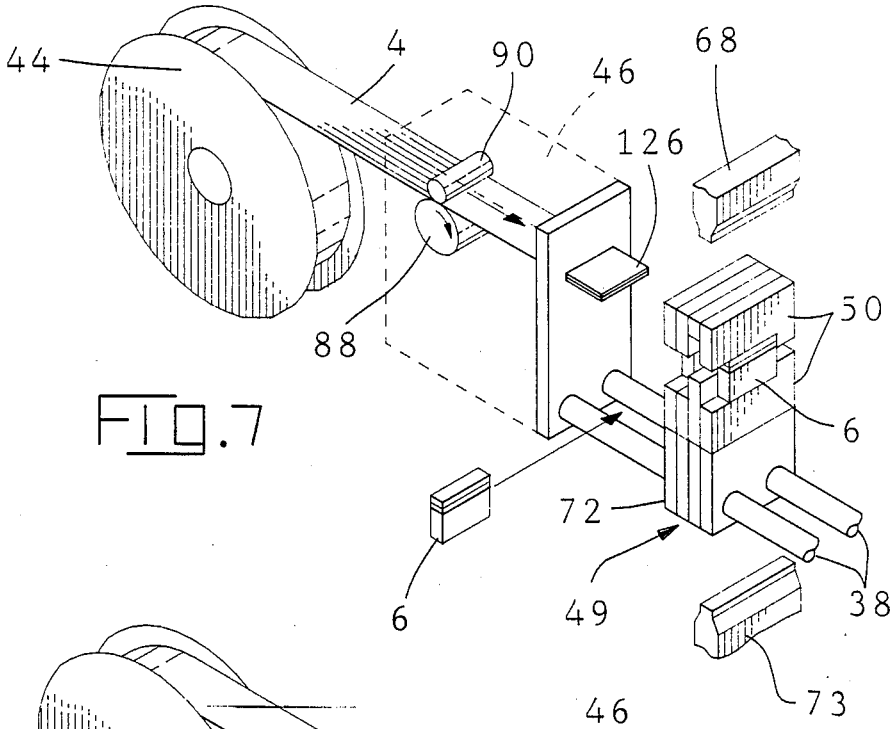
FIGS. 7–9 are diagrammatic views which illustrate the harness manufacturing process and particularly the role of the cable guide in the process.

The applicator assembly 48 comprises an air cylinder 66 and a press ram 68 (FIG. 7) on the piston rod extending from the cylinder. The ram 68 moves against the upper body portion of the carrier during an installation process. Simultaneously, a lower ram 73, FIG. 7, is provided which supports the underside of the carrier 72 on which the fixture is supported. This arrangement avoids the imposition of relatively high loads on the guide rails 38 during a connector installing process.

The feeding unit or dispensing unit 46 (FIG. 4) comprises a base plate 76 having bearing portions which are slidably supported on the guide rails 38 for limited movement along the rails 38. Side plates 78 extend upwardly from the base plate. Lower transversely extending support plates 80, 82 and upper transverse plates 84, 86 extend between the opposed surfaces of the side plates. The lower and upper transverse plates 80, 82 are spaced from the plates 82, 86 and the feed rolls 88, 90 are located between the two sets of plates. The cable 4 extends over the upper surfaces of the plates 80, 82 and between the rolls. Suitable channel means or other guide means are provided for precisely guiding the cable along its feed path. In the present example, the lower feed roll 88 is a driven roll while the upper feed roll 90 is an idler, however, both rolls may be driven. The feed roll 88 is only required to feed the cable a very short distance, through the connector stack and into terminating position in the leading connector that is positioned in the installing station. The feeding means for rotating the roll 88 may be any desired type, a rack and pinion arrangement actuated by a pneumatic cylinder being well suited for this purpose.

Figure 4:
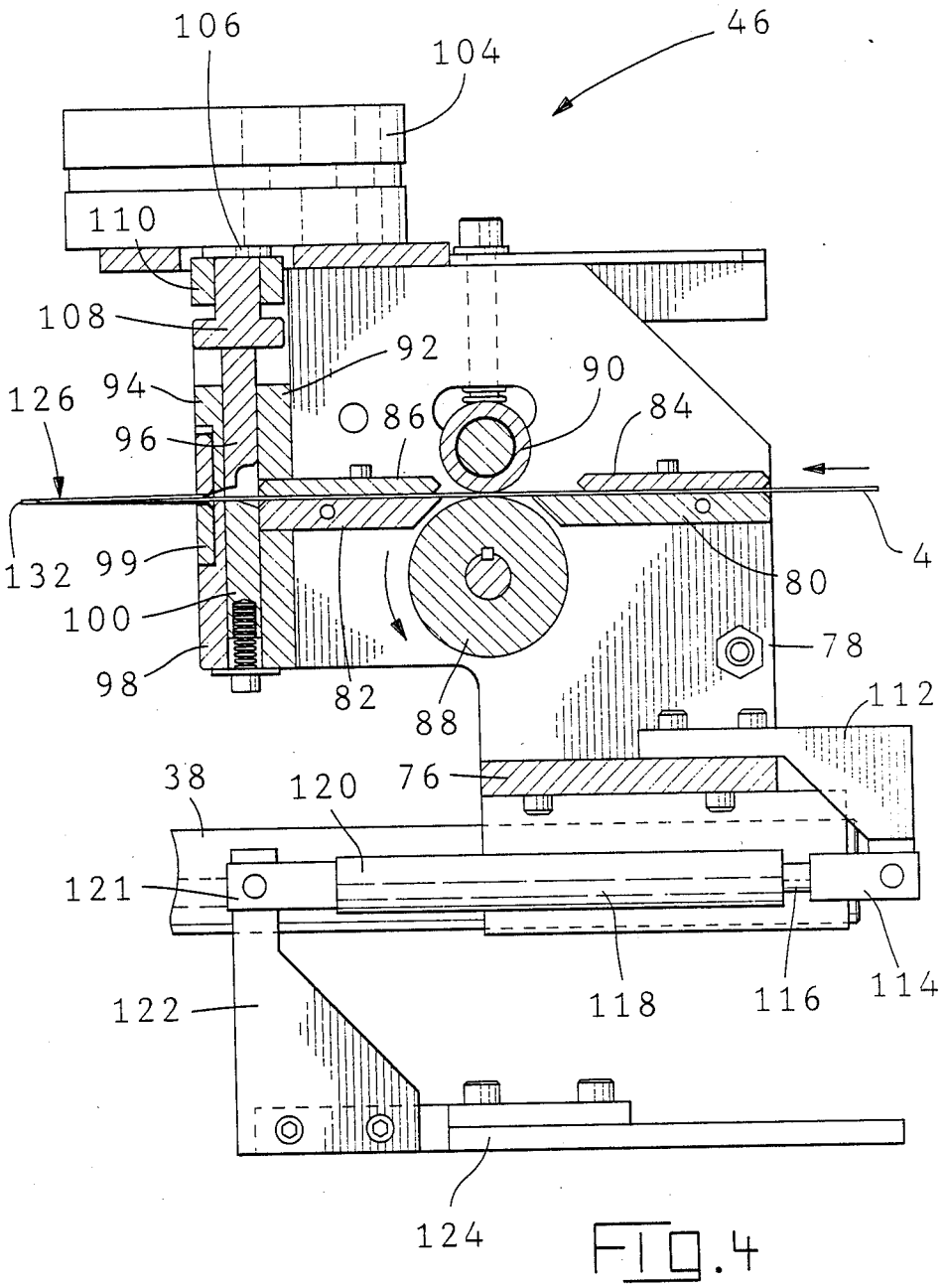
FIG. 4 is a sectional side view of the cable feeding or dispensing unit.
Figure 5:
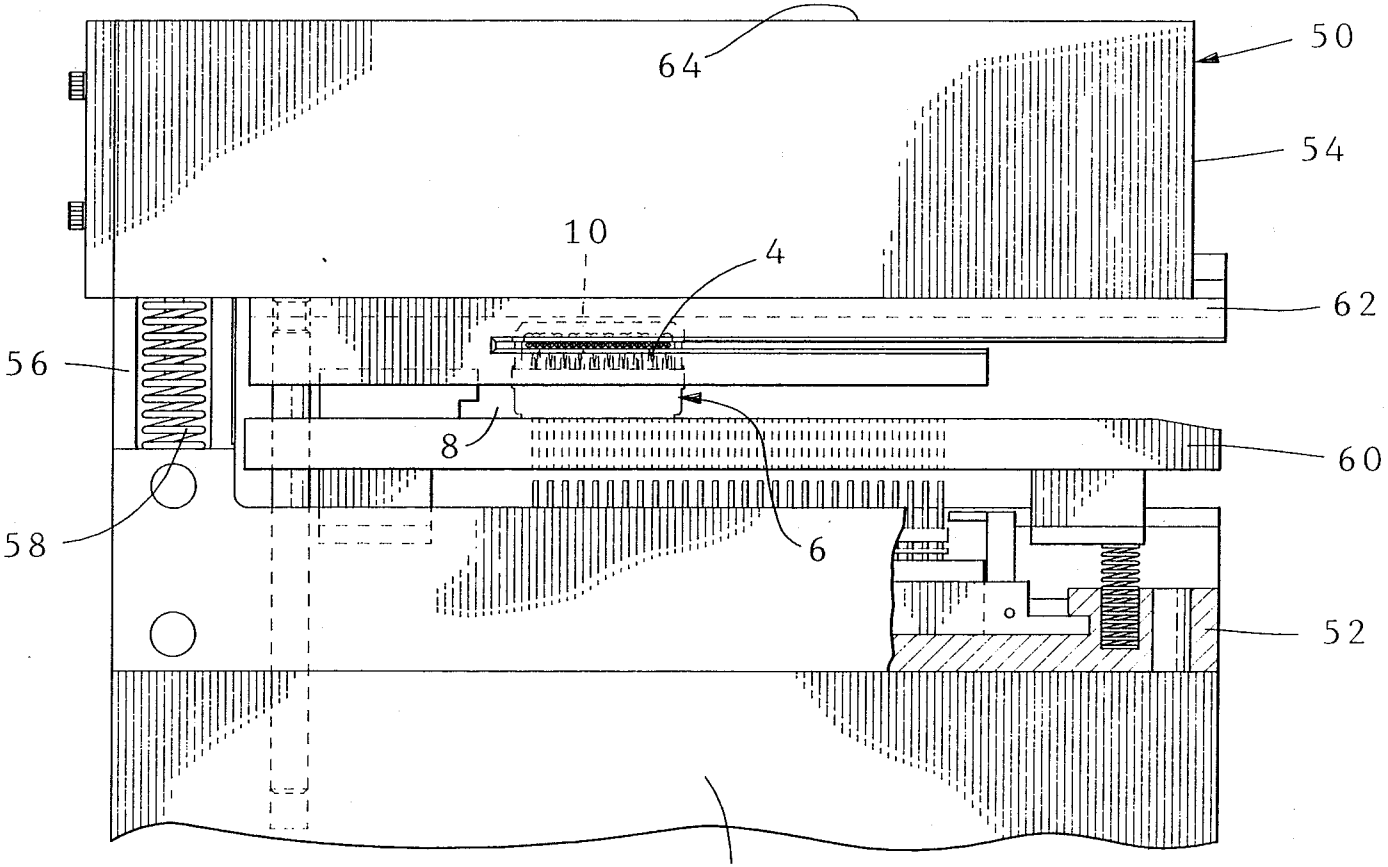
FIG. 5 is a view showing one of the fixtures used to hold a connector during the harness manufacturing process.
Figure 6:
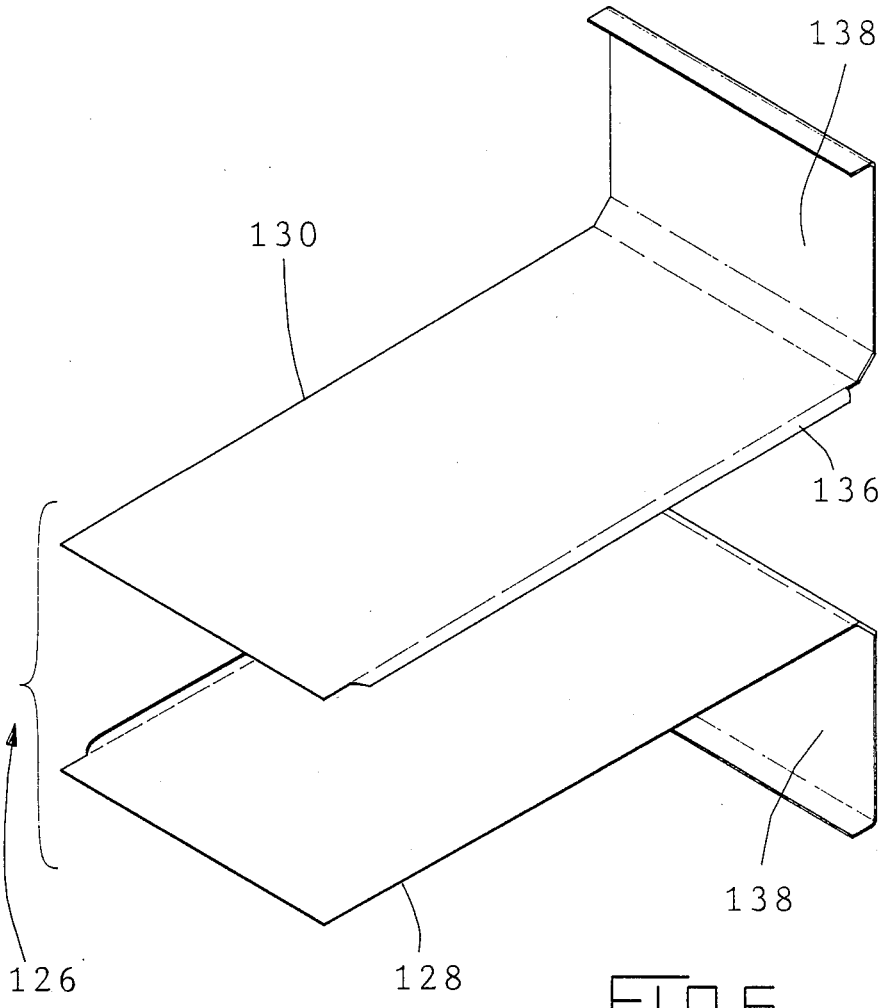
FIG. 6 is a perspective view of the cable guide.

A face plate 92 is secured against the left-hand edges as viewed in FIG. 4 of the side plates 78 and the transverse plates 82, 86 extend through an opening in this face plate. Leftwardly of the plate 92, a movable shearing blade 96 is provided in opposed relationship to a spring biased cable support plate 100. The shearing blade 96 is cooperable with a fixed shearing blade 98 which is against the support plate 100. In addition, a face plate 94 is provided in opposed relationship to the shearing blade 96. A recess is provided in the leftwardly facing surfaces of the plates 94, 98 and thin clamping plates 99 are positioned in this recess and clamp the cable guide 126 as will be described below.

The cable guide, FIGS. 4 and 6–9, comprises two co-extensive sheet metal plates or sections 128, 130 which project from the clamping plates 99. The inner ends of these sections have laterally extending flanges 138 which are clamped between the clamping plates and the plates 94, 98 as shown. The lower section 128 and the upper section 130 have opposed flat planar surfaces which are inclined towards each other and which therefore define a generally funnel-like structure having a rectangular cross-section. The upper and lower sections have flanges 136 which close off the sides of the guide and which prevent lateral movement of the cable as it is moving therethrough. The guide 126 has a free end 132 which is spaced from the clamping plate 99 by a specifically predetermined amount as will be described below.

During an operating cycle in which a complete harness is produced, it is necessary that the feeding unit 46 move along the rails 38 a short distance between a forward position and a retracted position. When the feeding unit is in its forward position, the free end 132 of the guide 126 is located adjacent to the leading connector in a stack of connectors contained in the staging zone 49 so that the guide itself extends through the connectors 6 which are behind the leading connector. The guide is thus relatively thin as it must be since it extends through the space between the underside of the covers of the connector and the upper ends of the terminals.

In order to permit the placement of a stack of connectors in the fixtures in the staging zone as shown in FIG. 7, it is necessary to move the connector guide rearwardly and away from the staging zone so that the individual connectors can be placed in the fixtures. When the guide returns to its forward position, and after the connectors 6 have been placed in the staging zone, it will extend through the stack of connectors. The limited movement of the dispensing or feeding unit 46 will now be described.

An L-shaped bracket 112 is secured by fasteners to the base plate 76 of the feeding unit and has a depending arm which is coupled by a coupling member 114 to the piston rod 116 of a pneumatic piston cylinder 118. The left-hand end 120 of the cylinder is secured by means of an adapter member 121 to a bracket 122 which in turn is secured to a static frame portion 124. The stroke of the piston rod 116 is precisely equal to the amount by which the feeding unit must be moved between its forward and retracted positions. When it is desired to retract the feeding unit and the cable guide, it is merely necessary to pressurize the cylinder thereby to move the piston rod 116 rightwardly with resulting rightward movement, from the position of FIG. 4, of the feeding unit and the free end of the cable guide. The piston cylinder may have a spring return so that exhausting of the left-hand end of the cylinder will cause the feeding unit to return to its forward position. Alternatively, the cylinder 118 may be of the double acting type.

After a harness has been produced, it is necessary to cut the cable 4 at a location adjacent to the last connector in the harness. As previously mentioned, fixed and movable sharing blades 96, 98 are provided for this purpose. The movable sharing blade 96 is moved downwardly by a plunger 108 which is on the end of a piston rod 106 of a short stroke piston cylinder 104. This piston-cylinder is mounted on a suitable transverse support plate on the upper end of the frame plate 78.

Figure 8:
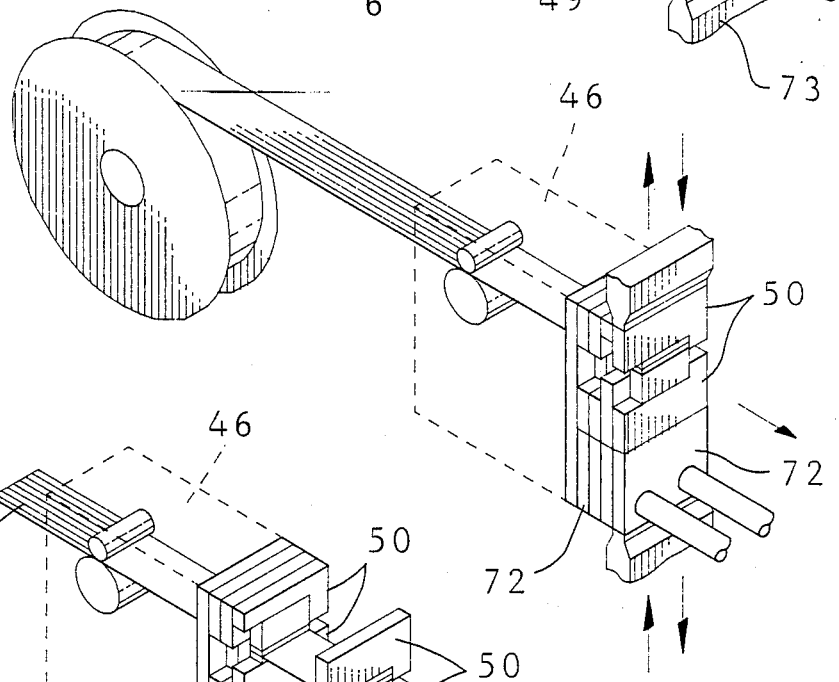
Figure 9:
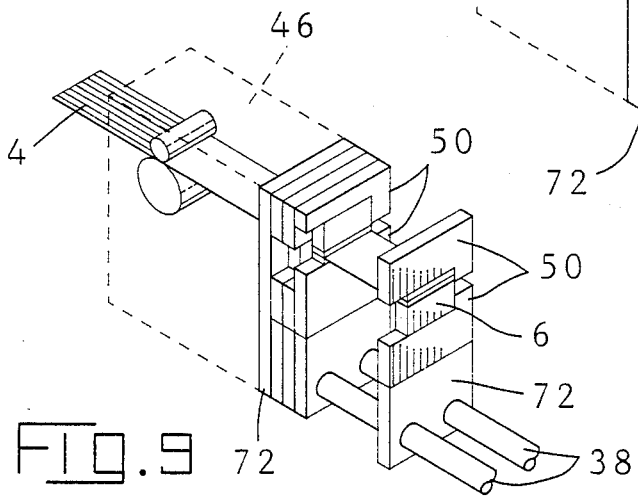

FIGS. 7–9 illustrate diagrammatically the operating sequence in which a complete harness is produced. At the beginning of the operating cycle, the feeding unit 46 will be in its retracted position (FIG. 7) so that individual connectors can be moved laterally in the direction of the arrows and positioned in the inserts of the fixtures. The loading of the connectors is advantageously carried out by means of a fully automatic loading mechanism contained in housing means as shown at 142 in FIG. 3. Alternatively, the connectors can be loaded by hand onto the individual fixtures. In either event, it is apparent that the cable guide must be in its retracted position so that the connectors can be placed in the staging zone. Thereafter, the feeding unit is moved to its forward position in which the leading end of the cable guide is immediately adjacent to the leading fixture of the stack 49. Ordinarily, the end of the cable is fed through the free end of the guide and into the leading connector. The cable is thereby protected from the upper ends of the terminals in the stack of connectors. When the parts have been moved to the positions of FIG. 8, the installing press 66 can be actuated to move the ram 68 and the lower ram 72 relatively towards each other at which time the leading connector in the stack will be installed on the cable. Thereafter, the leading carrier and the leading fixture (containing the leading connector) are moved for the desired distance along the rails 38. Movement of the leading fixture and carrier causes the cable to be pulled from the spool as explained in the above-identified U.S. Pat. No. 4,682,391. The stack of carriers and fixtures is then advanced in a suitable manner to position the next adjacent fixture and connector in the installing station.

The process is repeated for each of the connectors until all of the connectors in the stack have been installed on the cable. Thereafter, the cable is severed and the feeding unit is retracted in preparation for the next operating cycle.

I claim:

1. A machine for installing a connector on a ribbon cable, the machine comprising a connector installing station having installing means therein for installing the connector on the ribbon cable, a connector positioning means adjacent the installing station for locating the connector relative to the installing means, and a cable dispensing unit proximate to the installing station for dispensing cable from a cable source to the installing station, the machine being characterized in that:

a cable guide is provided on the dispensing unit, the cable guide extending cantilever fashion from the dispensing unit towards the installing station, the guide having a free end which is spaced from the dispensing unit, means for moving the cable guide between a retracted position and a forward position, the free end of the cable guide extending substantially through the connector positioning means and being adjacent to the installing station when the cable guide is in its forward position, the cable guide being retracted from the installing station when the cable guide is in its retracted position whereby, a connector can be placed in the connector positioning means when the dispensing unit is in its retracted position, and upon movement of the cable guide to its forward position.

2. A machine as set forth in claim 1 characterized in that the cable guide is fixed to the dispensing unit and the dispensing unit is movable between a retracted position and a forward position whereby the connector guide is moved between its retracted and forward positions.

3. A machine as set forth in claim 1 characterized in that the cable guide has one planar panel section wich extends parallel to the direction of cable movement when the cable is being dispensed, the one panel section supporting the cable during dispensing.

4. A machine as set forth in claim 1 characterized in that the cable is dispensed from the cable source in a horizontal plane and the cable guide extends parallel to, and is moved parallel to, the cable.

5. A machine as set forth in claim 1 characterized in that the cable guide is a funnel-like member having a rectangular cross-section and having spaced-apart co-extensive flat panel-like members which extend from the dispensing unit to the free end, the cable being confined between the opposed internal surfaces of the panel-like members.

6. A machine as set forth in claim 5 characterized in that the cable guide has side sections extending between the side edge portions of the panel-like members for confining the cable against lateral movement.

7. A machine as set forth in claim 1 characterized in that a connector holding zone is provided between the installing station and the dispensing unit, the holding zone being capable of holding a plurality of connectors therein whereby an individual connector can be moved from the holding zone to the installing station during each operating cycle of the machine, the cable guide extending from the dispensing unit through the holding zone to the installing station, the free end of the cable guide being retracted beyond the holding zone when the cable guide is in its retracted position thereby to permit loading of a plurality of connectors in the holding zone.

8. A machine for installing a plurality of two-part connectors on a ribbon cable, the machine having a connector installing station having installing means therein for pressing the two parts of the connector onto a ribbon cable which extends between the two parts of the connector, a connector holding zone on one side of the installing station for holding a stack of connectors which are to be sequentially moved to the installing station and installed on the cable, a cable feeding means in alignment with the connector holding zone and the installing station for initially feeding cable from a cable source to the leading connector in the stack at the installing station, and connector guide means for guiding a connector which has been installed on a cable along a cable feed path which extends away from the installing station, the machine being characterized in that:

a cable guide is provided on the feeding unit, the cable guide extending cantilever fashion from the feeding unit through the holding zone and to the installing station, the guide having a free end which is spaced from the feeding unit, means for moving the cable guide between a retracted position and a forward positions, the cable guide extending through the holding zone so that the free end is adjacent to the installing station when the guide is in its forward position, the cable guide being retracted from the holding zone when the cable guide is in its retracted position whereby, connectors can be stacked in the holding zone when the cable guide is in its retracted position, and upon movement of the cable guide to its forward position, the cable guide will extend through the connectors in the stack and its free end will be proximate to the leading connector in the stack and adjacent to the installing station so that cable can be initially fed through the connectors in the stack to the installing station.

9. A machine as set forth in claim 8 characterized in that the cable guide is fixed to the feeding unit and the feeding unit is movable between a retracted position and a forward position whereby the connector guide is moved between its retracted and forward positions.

10. A machine as set forth in claim 8 characterized in that the cable guide has one planar panel section which extends parallel to the direction of cable movement when the cable is being fed, the one panel section supporting the cable during feeding.

11. A machine as set forth in claim 8 characterized in that the cable is fed from the cable source in a horizontal plane through the holding zone to the installing station and the cable guide extends parallel to, and is moved parallel to, the cable.

12. A machine as set forth in claim 8 characterized in that the cable guide is a funnel-like member having spaced-apart co-extensive flat panel-like members which extend from the feeding unit to the free end, the cable being confined between the opposed internal surfaces of the panel-like members.

13. A machine as set forth in claim 12 characterized in that the cable guide has side sections extending between the side edge portions of the panel-like members for confining the cable against lateral movement.

* * * * *